United States Patent [19]

Williamson et al.

[11] 4,056,884

[45] * Nov. 8, 1977

[54] METHOD OF MAKING A MINIATURE PLUG-IN FUSE

[75] Inventors: Harold L. Williamson, Northbrook; Avinash P. Aryamane, Mount Prospect, both of Ill.

[73] Assignee: Littelfuse, Inc., Des Plaines, Ill.

[ * ] Notice: The portion of the term of this patent subsequent to June 15, 1993, has been disclaimed.

[21] Appl. No.: 693,937

[22] Filed: June 8, 1976

Related U.S. Application Data

[60] Continuation-in-part of Ser. No. 610,978, Feb. 8, 1975, Pat. No. 3,962,782, which is a division of Ser. No. 432,980, Jan. 14, 1974, Pat. No. 3,909,767.

[51] Int. Cl.[2] ..... H01H 69/02

[52] U.S. Cl. ..... 29/623; 29/417; 113/116 P; 113/119; 337/198; 337/264; 337/295

[58] Field of Search ..... 29/623, DIG. 15, 414, 29/417; 339/62, 147 P, 208; 337/198, 187, 201, 206, 255, 262, 263, 264, 293, 295, 297; 113/119, 116 P

[56] References Cited

U.S. PATENT DOCUMENTS

| | | | |
|---|---|---|---|
| 1,777,916 | 10/1930 | Glossl | 29/623 X |
| 3,669,054 | 6/1972 | Desso et al. | 113/119 |
| 3,707,933 | 1/1973 | Berg | 113/119 X |
| 3,729,817 | 5/1973 | De Rouen | 29/610 R |
| 3,775,723 | 11/1973 | Mamrick et al. | 337/245 |
| 3,775,724 | 11/1973 | Mamrick et al. | 337/245 |
| 3,962,782 | 6/1976 | Williamson et al. | 29/623 |
| 3,967,369 | 7/1976 | Takano | 113/119 X |

FOREIGN PATENT DOCUMENTS

| | | | |
|---|---|---|---|
| 1,237,325 | 6/1960 | France | 29/623 |
| 456,749 | 7/1968 | Switzerland | 29/623 |

*Primary Examiner*—Victor A. DiPalma

*Attorney, Agent, or Firm*—Wallenstein, Spangenberg, Hattis & Strampel

[57] ABSTRACT

A method comprises the steps of providing a blank containing a pair of laterally spaced coplanar terminal forming blade portions which are interconnected by a transverse rigid web, coplanar current carrying extensions thereof and an interconnecting relatively fragile fuse-forming link inserting around the blank a housing made of insulating material with the current carrying extensions of the blank and the interconnecting fuse-forming link preferably within the housing and with the pair of terminal blade portions of the blank and the transverse web on the outside of the housing, securing said blank to the housing so the housing rigidly interconnects and supports the current carrying extensions, and blanking the exposed transverse web interconnecting the terminal blade portions.

19 Claims, 15 Drawing Figures

FIG. 1
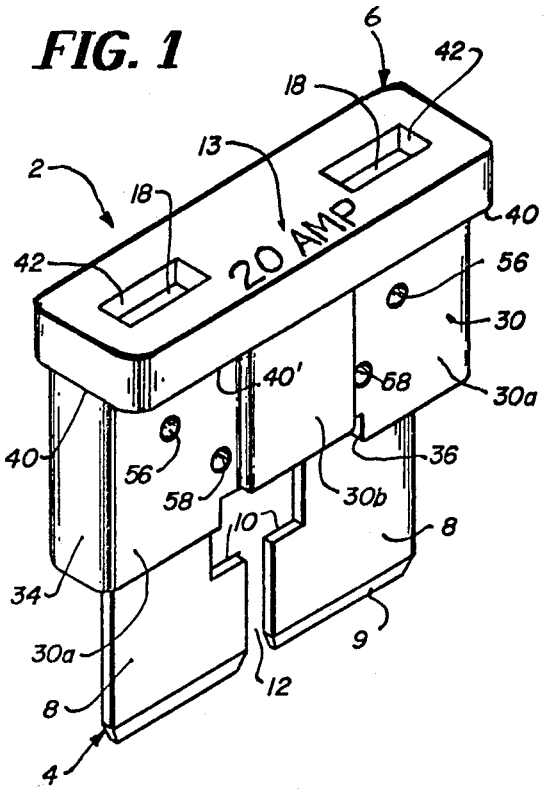
FIG. 2
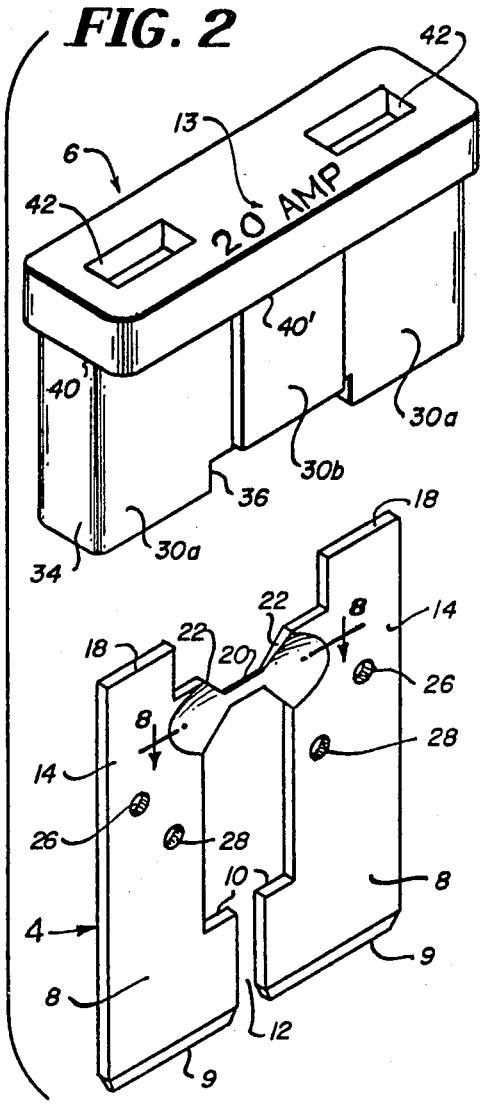
FIG. 3
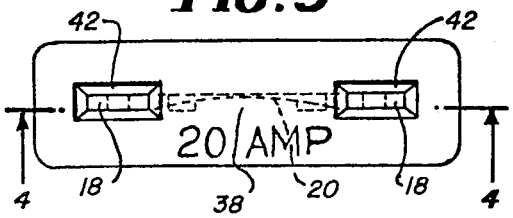
FIG. 4
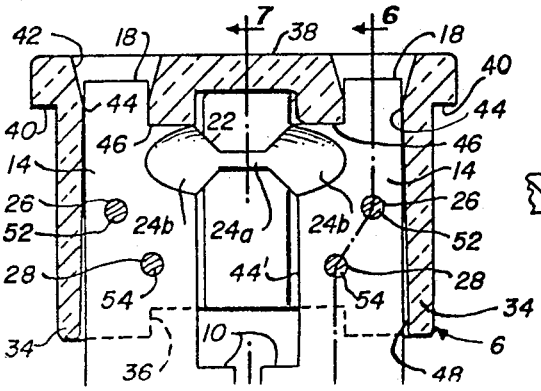
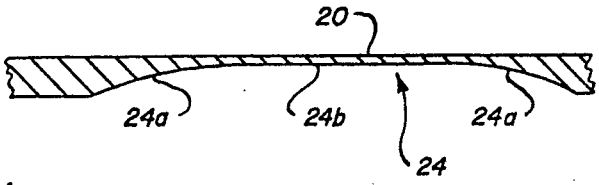
FIG. 8

FIG. 5
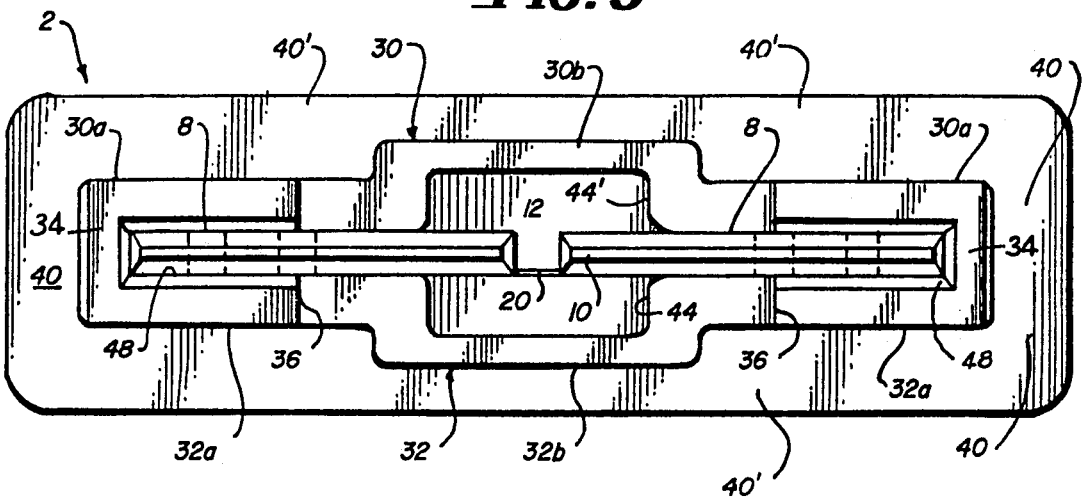
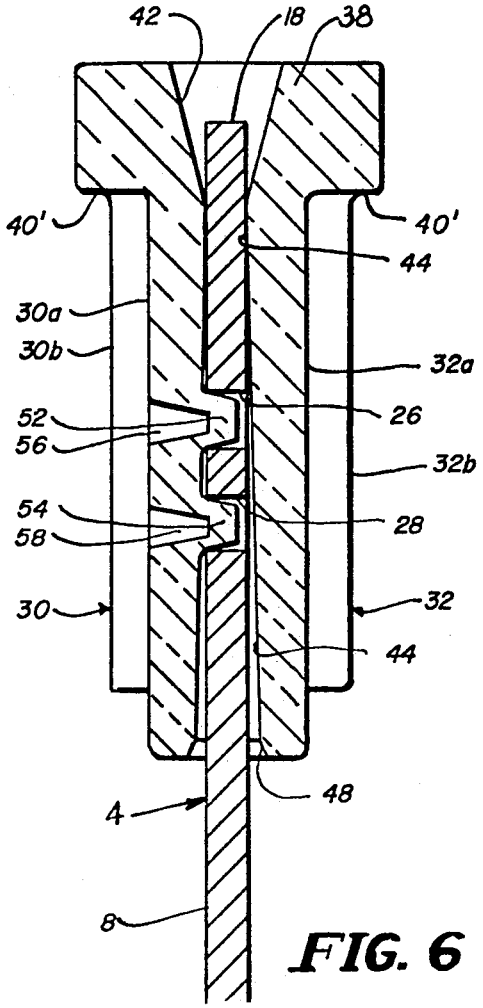
FIG. 6
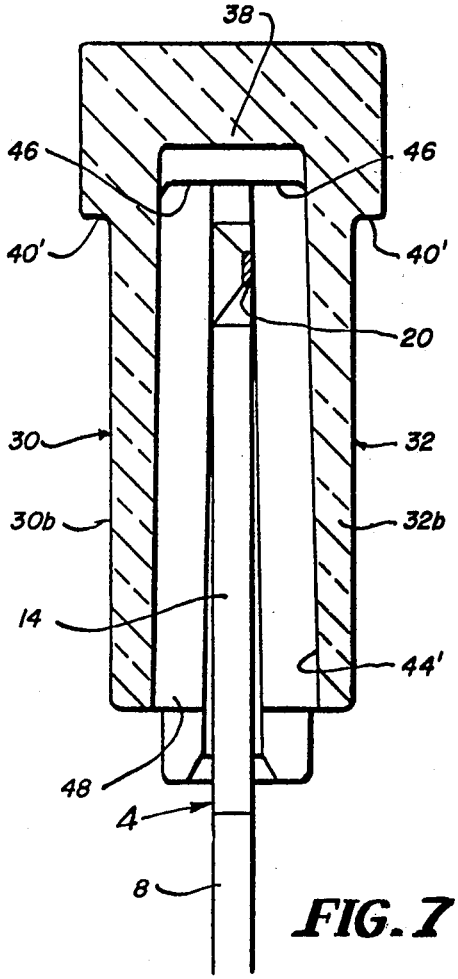
FIG. 7

FIG. 9
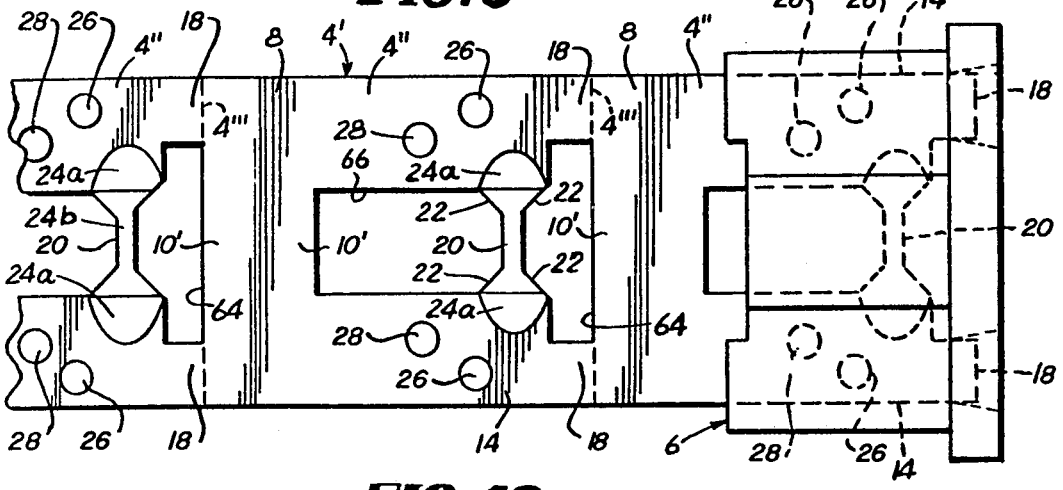
FIG. 10
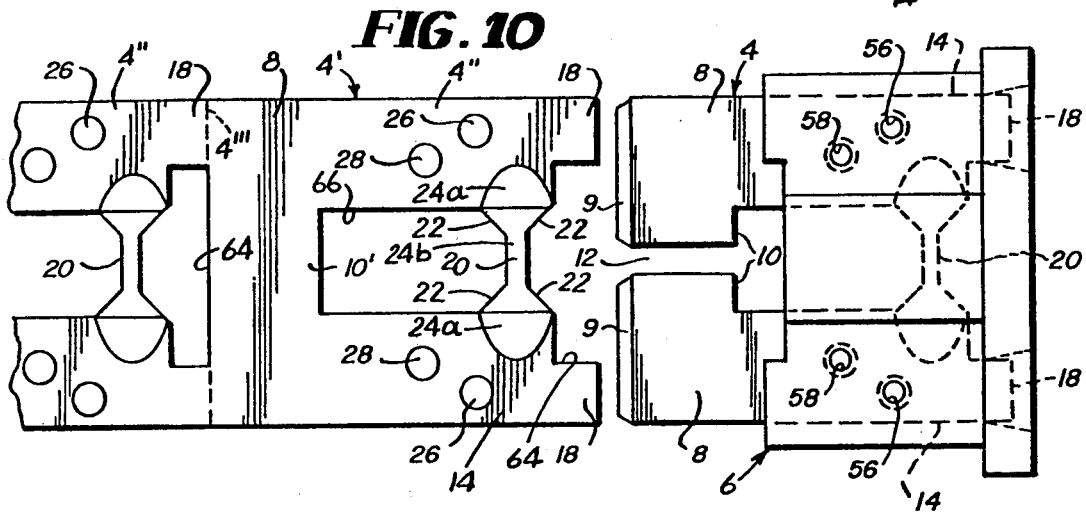
FIG. 11
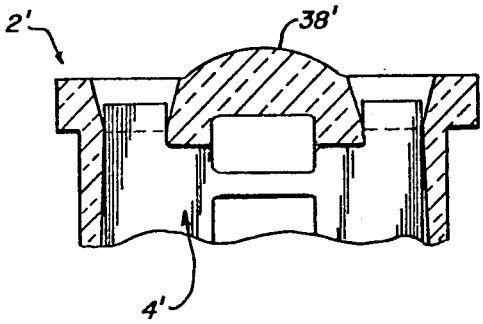
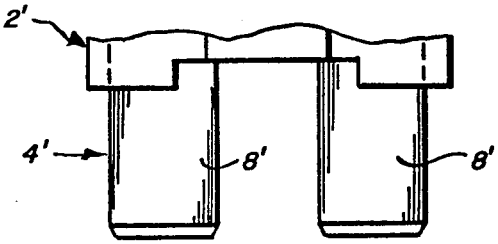
FIG. 12

METHOD OF MAKING A MINIATURE PLUG-IN FUSE

RELATED APPLICATION

This application is a continuation-in-part of application Ser. No. 610,978, filed Feb. 8, 1975 for Method of Making A Miniature Plug-In Fuse with Fragile Fuse Link (now U.S. Pat. No. 3,962,782) which in turn is a division of application Ser. No. 432,980, filed Jan. 14, 1974, for Miniature Plug-In Fuse (now U.S. Pat. No. 3,909,767).

BACKGROUND OF THE INVENTION

The present invention relates to miniature current overload fuses which, whether they are rated to carry only a few amperes or as much as 30 amperes, preferably occupy a space which is only a fraction of the space occupied by the conventional glass envelope cylindrical fuses.

A marked improvement in overload current fuses having a rating of from 10–30 amperes has been made where the fuse has a length well under ¾ inch and a width of under ¼ inch. Such a fuse is disclosed in U.S. Pat. No. 3,436,711. Also, the terminals of the improved fuses plug into socket openings transversely to the length of the fuse body, so the socket connector can be a much less expensive and less bulky support means than that needed for conventional high current rated fuses.

While the miniature fuses heretofore developed have been a substantial improvement over the conventional cylindrical glass envelope fuses, they still left much to be desired from the standpoint of their cost of manufacture and/or protection to the user. For example, in some of the miniature fuses heretofore developed, the fuse link was exposed so that the insertion thereof into a shorted circuit would blow the same and spew fuse material onto the person inserting the fuse. Also, it was possible for a person inserting or removing such a fuse to make contact with the exposed fuse link which created a shock hazard if he engaged the fuse negligently. While in one form of miniature fuse heretofore developed, as for example, that disclosed in U.S. Pat. No. 3,775,723, the fuse link was enclosed in a transparent housing having a handle extending from the outer walls thereof, the fuse was relatively expensive to manufacture and it had less reliability than the fuse of the present invention.

It is, accordingly, one of the objects of the invention to provide a method of making a miniature fuse which can be manufactured at a much smaller cost than the miniature fuses heretofore designed.

Another object of the invention is to provide a method of making a miniature fuse as described, wherein the fuse includes terminals projecting in parallel spaced relation transversely to the length of the fuse body.

A related object of the invention is to provide a method of making a miniature fuse as described and having a housing providing an insulated gripping surface and a shield protecting the user from being contacted by the fuse material as an inserted fuse is blown.

In most of the miniature fuse designs heretofore proposed, the terminals have cylindrical pin-like configurations molded into bases of insulating material, and the fuse links were soldered between the inner ends of these terminals. The presence of solder connections sometimes created problems of reliability resulting from corrosion or hot spots due to poor solder connections or deterioration with age. Thus, another object of the present invention is to provide a method of making a miniature fuse having features satisfying one or more of the objectives previously discussed and, in addition, are devoid of the corrosion or hot spot problems referred to.

SUMMARY OF THE INVENTION

The most preferred form of the invention deals with a unique method of which makes the plug-in fuse assembly disclosed in application Ser. No. 432,980 filed Jan. 14, 1974, now U.S. Pat. No. 3,909,767. (However, in its broadest aspect, the invention deals with a method of making plug-in fuse assemblies which differ from the configuration and construction disclosed in this patent.) The plug-in fuse assembly disclosed in this application which is especially suitable for fabrication by the method of the present invention, comprises a plug-in fuse element including a coplanar plate-like body of fuse metal having a pair of laterally spaced coplanar terminal forming blade portions to be received by pressure clip terminals in a mounting panel. Coplanar current carrying extensions project longitudinally from the inner end portions of the pair of terminal forming blade portions, and the plug-in fuse element as a fuse-forming link preferably extending transversely between the current carrying extensions. A synthetic plastic housing, which can be comprised of two confronting housing halves which can be assembled or snapped over the plug-in element, but which is preferably a one piece housing which is open at the inwardly facing side thereof, closely envelopes the current carrying extensions and spacially encloses the fuse-forming link, with the pair of terminal forming blade portions of the plug-in fuse element extending outwardly from the housing.

In accordance with one aspect of this method invention, an entire plug-in fuse element including both terminal and fuse-forming portions thereof is formed preferably from a strip of fuse metal where at the end of the strip the strip is progressively blanked to form a one-piece coplanar plate-like body preferably having the configuration just described, namely a body housing juxtaposed laterally spaced generally parallel terminal forming blade portions to be received by pressure clip terminals in a mounting panel, the terminal forming blade portions having current carrying longitudinal extensions at the inner end portions thereof which are interconnected by a fuse-forming link portion of much smaller cross-sectional area than the terminal-forming blade portions and the current carrying extensions thereof. While the fuse-forming link portion could be formed in a direction extending longitudinally of the terminal forming blade portions and the strip, it is most preferably formed in the direction extending between the current carrying longitudinal extensions of the terminal forming blade portions, that is, in a direction extending transversely or laterally therebetween.

The blanking of the strip interconnecting the terminal blade portions may be such as to provide the pair of exposed laterally spaced coplanar terminal portions with selected widths corresponding to the ampere rating of the plug-in fuse assembly. Also, the outer end portions of the exposed pair of terminal forming blade portions may be coined to form tapers thereon to facilitate insertion thereof into the clip terminals in mounting panel.

The blank of fuse metal is preferably initially provided with a central portion of reduced thickness so that, when the blank is blanked, the interconnecting fuse-forming link portion of the blank is of less thickness than the spaced coplanar terminal forming blade portions and the current carrying extensions. By controlling the thickness of the fuse-forming link portion and the width thereof desired selected ampere ratings for the fuse assembly may be obtained. The central portion of reduced thickness of the blank of fuse metal may be reduced by milling or by milling and subsequent squeezing.

While the method aspects of the invention are most advantageously carried out using a strip of fuse metal where the previously desired copolanar plug-in fuse elements can most easily be blanked and severed from the end of the advancing strip of fuse metal, the broader aspects of the invention do not so require.

Another unique aspect of the present method invention, is that a completely housed plug-in fuse assembly is formed in a mass production operation where, after the formation of a plug-in fuse element forming an all metal body subcomponent including parallel spaced terminal forming blade portions, current carrying extensions and the interconnecting fuse-forming link portion, the fuse assembly is completed by applying only an insulating housing thereto, which housing preferably is a one-piece housing with an opening in one end thereof, so the housing is simply applied to the plug-in fuse element by inserting the fuse element through the opening and staking or otherwise anchoring the housing directly to the plug-in fuse element. The housing most advantageously contains spaced compartments with defining walls which closely confines the south current carrying extensions of the plug-in fuse element and a connecting compartment with walls spaced from the fuse-forming link portion thereof.

Further objects of this invention reside in the particular method steps and in the cooperative relationship between the method steps in making the aforementioned plug-in fuse assembly.

DESCRIPTION OF THE DRAWINGS

FIG. 1 is a perspective view of a preferred form of the plug-in fuse assembly of the invention;

FIG. 2 is an exploded view of the housing and plug-in fuse element making up the plug-in fuse assembly of FIG. 1;

FIG. 3 is a top plan view of the plug-in fuse assembly of FIG. 1;

FIG. 4 is a vertical longitudinal sectional view through the fuse assembly shown in FIG. 3, taken along section line 4—4 therein;

FIG. 5 is an enlarged bottom view of the plug-in fuse assembly of FIG. 1;

FIG. 6 is an enlarged transverse vertical sectional view through the fuse assembly shown in FIG. 4, taken along section line 6—6 thereof;

FIG. 7 is an enlarged vertical transverse sectional view through the center portion of the fuse assembly shown in FIG. 4, taken along section line 7—7 thereof;

FIG. 8 is a greatly enlarged fragmentary sectional view through the fuse link portion of the plug-in fuse assembly shown in FIG. 2, taken along section line 8—8 thereof, and showing the manner in which the fuse-forming link portion thereof is reduced in thickness by a combination milling and pressing operation;

FIG. 9 illustrates the insertion of the housing of the fuse assembly of FIGS. 1–8 onto the end of a pre-milled and pre-stamped strip of fuse metal from which numbers of plug-in fuse elements like that shown in these figures are formed;

FIG. 10 shows the separation of a completed plug-in fuse assembly from the strip shown in FIG. 9, after a strip staking and severing operation has been carried out;

FIG. 11 illustrates a fragmentary longitudinal sectional view through a portion of a plug-in fuse assembly like that shown in FIGS. 1–10 but which has been modified by adding a magnifying lens to the outer wall of the housing thereof;

FIG. 12 illustrates a fragmentary side elevational view of a plug-in fuse assembly modified from that shown in FIGS. 1–11 in that the wings on the terminal-forming blade portions of the plug-in fuse element have been removed to indicate a lower current rated fuse.

DESCRIPTION OF THE PREFERRED EMBODIMENT OF THE INVENTION

Figure 13:
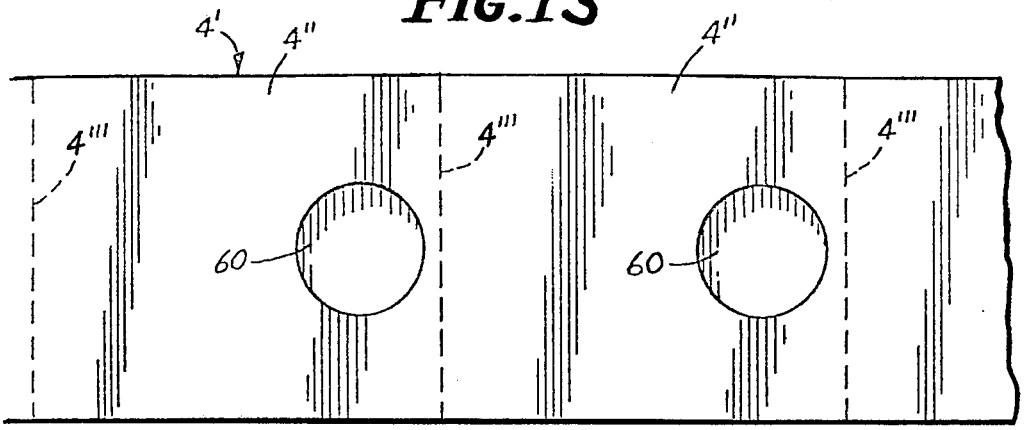
FIG. 13 illustrates the milling of the strip before it is blanked or stamped as illustrated in FIGS. 9 and 10.
Figure 14:
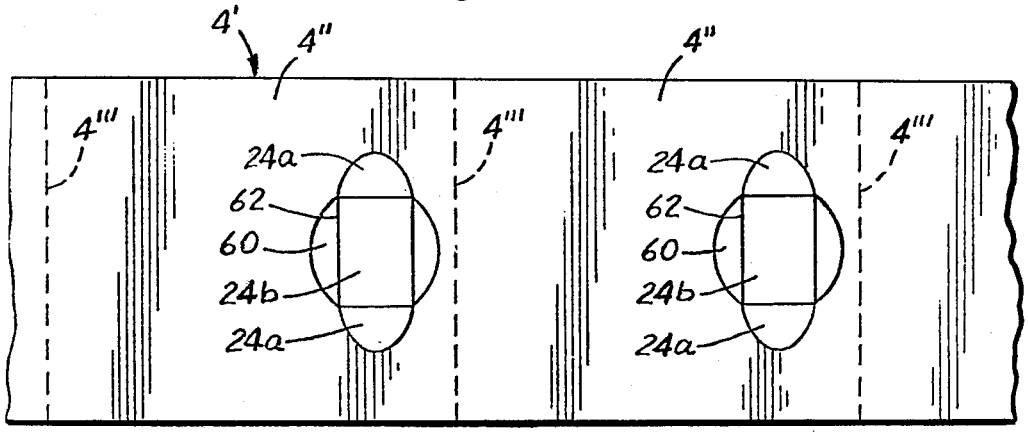
FIG. 14 illustrates the milled strip of FIG. 13 after it is squeezed or compressed and before it is blanked or stamped as illustrated in FIGS. 9 and 10.

Referring now more particularly to FIGS. 1–4, there is shown a plug-in fuse assembly 2 made of only two component parts, namely a plug-in fuse element 4 which most advanageously is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking operation to be described.

The plug-in fuse element 4 has terminal-forming blade portions 8—8 extending in spaced parallel relationship from the inner or bottom margin of the housing 6 in what will be referred to as a downward or inwardly extending direction. The ends of the terminal-forming blade portions 8—8 of the plug-in fuse element are most advantageously tapered at 9—9 to form pointed end portions which readily slip into place between the confronting walls of conventional spring clip terminals (not shown) supported in mounting panel apertures. The terminal-forming blade portions 8—8 of the plug-in fuse element 4 have inwardly extending rough current rating indicating wings or projections 10—10, to provide a more massive appearance to the exposed terminal-forming portions 8—8 of the plug-in fuse element 4, identifying the fact that the fuse assembly is one having a relatively high current rating, such as in the range of from 20 to 30 amps. (The exact current rating is indicated by indicia 13 on the outer walls of the housing as shown in FIGS. 1–3. Where a plug-in fuse element has a relatively low current rating such as 5 to 15 amperes, the wings 10—10 are eliminated so the user knows immediately that the plug-in fuse element which does not have any wings is for a lower current rated application. Such a plug-in fuse element is shown in FIG. 12.)

The plug-in fuse element 4 is stamped from a strip 4' of fuse metal (FIGS. 9 and 10 and 13 to 15). Prior to the plug-in fuse element being severed from the strip 4', the wings 10—10 are interconnected to form a transverse rigidifying web 10' for the strip 4', and so a narrow piece of material is stamped from the transverse web 10' to form the terminal-forming blade portions 8—8 and a gap 12 between the same. The tapered portions 9—9 of the terminal-forming blade portions 8—8 may be formed by coining dies (not shown) during the operation which severs the plug-in fuse element from the strip or preferably thereafter.

The terminal-forming blade portions 8—8 have current carrying extensions 14—14 projecting into the aforementioned space formed by the housing 6, which current-carrying extensions project well up into the upper or outer extremities of the housing 6, to be contiguous to the front or outer wall of the housing to be described. The outer end portions of the current-carrying extensions 14—14 are interconnected by a fuse-forming link portion 20 which is preferably both narrower in width and much smaller in thickness than the other current-carrying portions of the plug-in fuse element 4. The current-carrying capacity of the fuse-forming link portion 20 may be varied by varying the fuse metal composition or by varying the width and/or the thickness of the fuse-forming link portion. In the particular configuration of the plug-in fuse element 4 shown in the drawings the current carrying extensions 14—14 join the fuse-forming link portion 20 of the plug-in fuse element 4 by tapered portions 22—22. All of the various parts of the plug-in fuse element are substantially in coplanar relation so no metal bending operations need be performed in the process of making the same.

It was found that a reduction of the thickness of the metal of the fuse-forming link portion 20 is preferably achieved by a milling operation which mills away the metal on one side thereof to form a generally curved depression 24 best shown in FIG. 8. The outer portions of this depression 24 are identified by reference numerals **24*a*—24*a* and may represent the milled surfaces. The flattened intermediate portion 24*b* of the depression 24 may be obtained by squeezing or pressing the metal to further reduce this thickness thereof. On the other hand, following an initial milling step, both the curved outer portions 24*a*—24*a* and the flattened intermediate portion 24*b* of the depression 24 may be obtained by squeezing or pressing. For example, it was found that in one plug-in fuse element, the thickness of the fuse metal was reduced from an initial thickness of 0.027 inches to about 0.005 inches by a milling operation, and a further reduction of 0.002 inches was achieved by a pressing operation, ending up with a minimum thickness of the fuse-forming link portion 20 of 0.003 inches. Of course, the precise thickness of the fuse metal depends upon the fuse metal composition, the width of the fuse-forming link portion 20** and the desired current rating of the fuse.

While the plug-in fuse element 4 may be used as a fuse element without its incorporation in the housing 6, for safety reasons it is preferred to incorporate the plug-in fuse element 4 in the housing 6. To this end, and for reasons to be explained, the outer end portions of the terminal extensions 14—14 are provided with outwardly or upwardly projecting tabs 18—18 adapted to make contact with test probes to test for the continuity of the fuse-forming link portion 20 of the plug-in fuse element 4. Also, to anchor the plug-in fuse element 4 within the housing 6, anchoring apertures 26—26 and 28—28 are respectively formed in the terminal extensions 14—14 to receive anchoring projections to be described formed in the housing walls.

While the housing 6 could be made in two separate parts snappable together, the housing is most advantageously a single piece molded part as previously indicated. Also, it preferably has a narrow elongated configuration formed by relatively closely spaced side walls generally indicated by reference numeral 30–32, the side walls having end portions **30*a*–32*a* and 30*a*–32*a* which are spaced together much more closely than the central or intermediate portions 30*b*–32*b* thereof. The side walls 30–32 are interconnected at their end margins by narrow end walls 34—34, and at their outer or top margins by an outer wall 38 which overhangs the rest of the housing to form downwardly facing shoulders 40—40 at the longitudinal ends of the outer wall 38 and downwardly facing shoulders 40'—40' along the longitudinal side margins of the housing 6. The shoulders 40'—40' are coplanar continuations of the shoulders 40—40 at the ends of the housing 6**.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immdiately beneath the access openings 42—42 are relatively small because of the close spacing of the side wall portions **30*a*–32*a* of the housing at these points, the width of the space portions 44—44 as viewed in FIG. 6 tapering from the bottom open end of the housing upwardly toward the terminal access openings 42—42, reaching a narrow dimension about equal to the thickness of the plug-in fuse element 4. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8** of the plug-in fuse element.

The fuse-forming link portion 20 of the fuse element 4 is positioned in a relatively wide portion 44' (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44' of the space within the housing 6 open onto the bottom of the housing for the full extent thereof through an entry opening 48. The opening 48 permits the housing to be pushed over the end portion or end blank of the prestamped and milled strip 4' from which a completed fuse element is punched immediately following the securing of the housing 6 to the end portion or end blank of the strip as previously indicated.

The housing 6 is preferably a molded part made of a transparent synthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing is preferably molded of a high temperature transparent nylon made by Belding Chemical Industries of New York City, N. Y. (Product Code No. LX-3330).

While the housing interior 6 could be made with resilient projections which snap into the anchoring apertures 26—26 and 28—28 in the plug-in fuse element 4, it is preferred to secure the housing in place by forming projections 52 and 54, by a cold staking operation, ultrasonic melting or other operation, which enter the anchoring apertures 26—26 and 28—28 of the plug-in fuse element 4. The depressions 56 and 58 left by a staking operation are shown in the side wall 30 in FIGS. 1 and 6.

To improve the visibility of the fuse-forming link portion 20 of the plug-in fuse element, the outer wall of the housing of the fuse assembly can be modified as shown in FIG. 11 where the housing outer wall 38' of a modified fuse assembly 2' is thickened and curved to form a magnifying lens. Also, as shown in FIG. 12, the fuse assembly 2' is a low current rated fuse assembly as evidenced by the absence of wings on the terminal-forming blade portion 8'—8' on the plug-in fuse element 4'.

The exemplary embodiments of the invention just described have thus provided an exceedingly reliable, compact and inexpensive to manufacture plug-in fuse assembly which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounted on the mounting panel. The terminal access openings enable test equipment to test the continuity of the fuse if the user does not desire to rely solely on a visual observation of the fuse-forming link portion of the fuse. The presence or absence of wings on the terminal-forming blade portion of the plug-in fuse element immediately informs the user whether he has selected a relatively high or low current rated fuse, although the indicia 13 should be examined to determine the actual current rating.

The preferred method of making the plug-in fuse assembly is illustrated in FIGS. 13, 14, 15, 9 and 10. It includes providing a continuous strip 4' of a fuse metal which is sequentially advanced the distance of a blank 4'' between distances of 4''' as indicated in dotted lines in these figures. In FIG. 13 the strip 4' is provided at spaced intervals with a milled portion 60, the milled portion 60 being provided in the appropriate place in each blank 4''. Thereafter, at each milled portion 60 each blank is squeezed or compressed as indicated at 62 in FIG. 14 to provide by squeezing or pressing a depression in the blank having curved surfaces **24*a*—24*a* and a flattened intermediate portion 24*b* as referred to above in connection with FIG. 8**.

Figure 15:
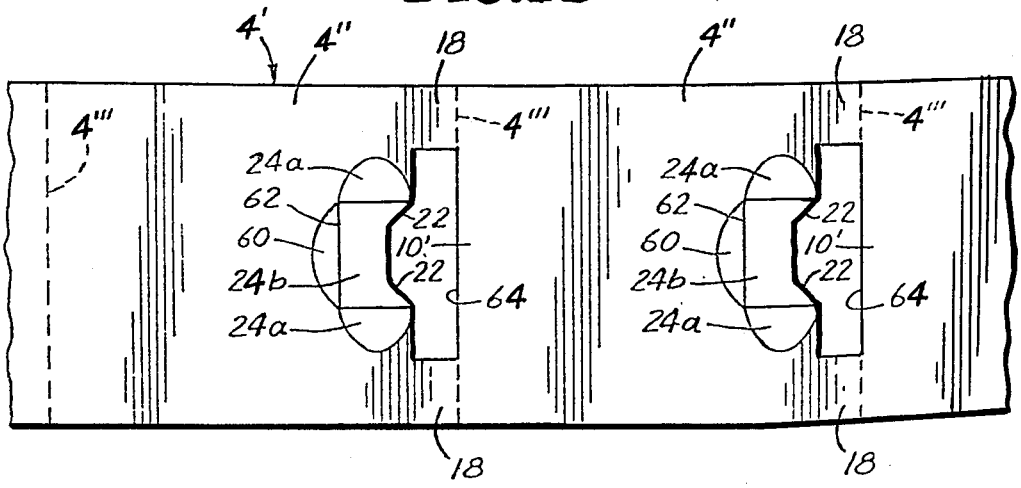
FIG. 15 illustrates the milled and squeezed strip of FIG. 14 after it has been partially blanked or stamped and before it is completely blanked or stamped as illustrated in FIGS. 9 and 10 in the event that it should be desirable to utilize two progressive stages of blanking or stamping instead of a single stage.

After the appropriate depression is formed in each blank 4'', the advancing strip 4' is then blanked to form the terminal portions 8, the current carrying extensions 14 thereof and the further extensions 18 thereof. This may be accomplished in one blanking operation or in a plurality of blanking operations. As illustrated herein, the blanking operation is accomplished in two steps. The first blanking step in the sequentially advancing strip 4' is illustrated in FIG. 15 wherein each blank 4'' is sequentially blanked as indicated at 64 to provide the extensions 18 and a portion of the fuse link 20 having the tapered portions 22. Thereafter, each blank is sequentially blanked as illustrated in FIG. 9 at 66 to provide the current carrying extensions 14 and the other part of the fuse link 20 extending between the current carrying extensions 14 having the tapered portions 22. During this same blanking operation the interlocking holes 26 and 28 are also blanked. In this blanking operation the transverse web 10' still remains between the terminal forming blade portions 8 of each blank.

As shown in FIG. 9, the housing 6 is inserted over the end blank 4'' to receive the current carrying extensions 14 and the fuse link 20 within the housing and with the terminal forming blade portions 8 still interconnected by the transverse web 10' extending from the housing. The housing is then cold staked and/or ultrasonically secured in the interlock openings 26 and 28 of the end blank 4'' as indicated at 56, 58 in FIGS. 6 and 10. Preferably, the placing of the housing 6 over the end blank 4'' and securing the housing to the end blank occurs before severing the end blank from the strip at the blank edge 4'''. In FIG. 10 the end blank 4'' and its housing 6 are severed from the strip 4' at the blank edge 4''' of the end of the blank 4''' to form the substantially completed plug-in fuse assembly, but with the transverse web 10' still intact. Thereafter, the transverse web 10' is blanked at 12 to provide the spaced apart terminal forming blade portions 8 as indicated at FIG. 10. Here, the blanking of the transverse web may provide wings 10 as illustrated in FIG. 10 or the wings may be eliminated as illustrated in FIG. 12. Thereafter, the ends of the terminal forming blade portions 8 may be coined as illustrated at 9 to form tapered ends for the blade portions. In this way, the complete plug-in fuse assembly as illustrated in FIGS. 10 and 1 may be provided.

While for purposes of illustration herein one preferred specific method of making the plug-in fuse assembly has been disclosed herein, other methods may become apparent to those skilled in the art and therefore this invention is to be limited only by the scope of the appended claims.

We claim:

1. A method of making a plug-in fuse element comprising a pair of juxtaposed laterally spaced generally parallel terminals to be received by pressure clip terminals or the like, the terminals having current-carrying extensions at the inner end portions thereof which are to be interconnected by a fuse link, said method comprising: providing a sheet-like body of fuse metal, and blanking said sheet-like body of fuse metal to form parallel mutually coplanar juxtaposed laterally spaced terminal forming blade portions, current-carrying extensions at the inner end portions of the terminal forming blade portions thereof and a fuse-forming link portion interconnecting said current-carrying extensions, said fuse-forming link portion being substantially smaller in cross-sectional area than the other portions of the blanked body of fuse metal.

2. The method of claim 1 wherein prior to said blanking step the body of fuse metal is reduced in thickness in the areas thereof in which said fuse-forming link portion is to be formed so such portion is both narrower in width and thinner in thickness than the terminal-forming blade portions and current-carrying extensions.

3. The method of claim 2 wherein said fuse-forming link portion of the body of fuse metal extends transversely between said current-carrying extension of the terminal-forming blade portions thereof.

4. The method of claim 1 wherein there is applied over the blanked body of fuse metal a housing made of insulating material which is open at the inwardly facing side thereof for the full width of the plug-in fuse element so as initially to receive said plug-in fuse element therethrough when it is assembled therewith, and said housing and plug-in fuse element are anchored together after assembly.

5. The method of claim 1 wherein there is applied immediately over said plug-in fuse element a housing made of insulating material including closely spaced side walls, which closely envelope said current-carrying extensions of said plug-in fuse element.

6. The method of claim 5 wherein said housing and plug-in fuse element are interlocked by projections formed in said housing which enter apertures in the plug-in fuse element.

7. The method as defined in claim 6 wherein the insulating body is ultrasonically heated where it is staked into the interlock openings in the blank.

8. A method of making a plug-in fuse assembly comprising a plug-in element including a pair of terminals to be received by pressure clip terminals or the like, a fuse-forming link forming at least part of an interconnection between the terminals, said method comprising the steps of providing a blank of fuse metal where the blank is initially provided with a portion of reduced thickness, and blanking said blank to form a pair of terminals which are at least in part interconnected by a fuse-forming link portion formed in said portion of reduced thickness, so that the fuse-forming link portion of the blank is of much less thickness and cross-sectional area than the terminals.

9. The method as defined in claim 8 wherein the portion of reduced thickness of the blank of fuse metal is reduced by milling.

10. The method as defined in claim 8 wherein the portion of reduced thickness of the blank of fuse metal is reduced by milling and subsequent squeezing.

11. The method of making a plug-in fuse element including a pair of spaced confronting generally parallel terminals to be received by pressure clip terminals or the like, current-carrying extensions at the inner end portions of the pair of terminals and a fuse-forming link interconnecting the current-carrying extensions, said method comprising the steps of providing a continuous strip of conductive material, sequentially advancing the continuous strip, blanking said continuous strip to provide at spaced intervals in said strip longitudinally interconnected blanks each comprising a pair of spaced confronting generally parallel terminal portions extending longitudinally along the strip, and a pair of current-carrying extensions of the terminal portions extending longitudinally along the strip and providing also a fuse-forming link extending laterally of the strip and between each pair of said current-carrying extensions thereof, and severing end blanks from the strip.

12. The method of claim 11 wherein there is added between the current-carrying extensions of each blank rigid insulating means which forms a rigid interconnection therebetween, with the pair of terminals of each blank extending from the insulating means.

13. The method of claim 11 wherein the insulating means applies to each blank, forms also a housing enclosing the fuse-forming link thereof.

14. The method of claim 11 wherein said continuous strip is made of fuse metal so that said fuse-forming link as well as said each pair of terminals are formed when the strip is blanked, and each severed end blank forms a one piece all fuse metal body.

15. The method as defined in claim 14 wherein the sequentially advanced continuous strip of fuse metal before it is blanked is initially provided with portions of reduced thickness within which the fuse-forming links are formed so that, when the strip of fuse metal is blanked, the interconnecting fuse-forming links of the longitudinally interconnected blanks are of less thickness than the spaced terminals thereof.

16. The method as defined in claim 15 wherein the portion of reduced thickness in the strip of fuse metal are arranged at longitudinally spaced intervals in the strip.

17. The method of making a plug-in fuse assembly comprising a plug-in element having a pair of spaced terminals to be received by pressure clip terminals or the like, current-carrying extensions at the inner end portions of the pair of terminals and a fuse link between said current-carrying extension, and a housing of insulating material, said method comprising the steps of providing a continuous strip of fuse metal, sequentially advancing the continuous strip, blanking said continuous strip after it is sequentially advanced to provide at spaced intervals in said strip longitudinally interconnected blanks each containing a pair of spaced terminals, current-carrying extensions at the inner end portions of the pair of terminals and a fuse link between said current-carrying extension, severing the end blanks from the strip, and applying and securing over each end blank a housing of insulating material with the current-carrying extensions and the fuse link of the end blank within the housing and with the pair of terminals of the end blank extending outwardly from the housing, said housing closely enveloping said current-carrying extensions but being spaced from said fuse link.

18. The method as defined in claim 17 wherein applying the housing over the end blank occurs before severing said end blank from the strip.

19. A method of making a plug-in fuse element comprising a plug-in element including a pair of spaced confronting generally parallel terminal forming blade portions to be received by pressure clip terminals or the like, a pair of confronting current carrying extensions projecting longitudinally from the inner ends of the pair of terminal forming blade portions and a fuse-forming link portion interconnecting the current carrying extensions, said method comprising the steps of providing a sheet-like blank of fuse metal initially provided within the longitudinal margins thereof with a portion of reduced thickness, blanking said blank including at least said portion of reduced thickness to leave a pair of spaced confronting general parallel terminal forming blade portions to be received by pressure clip terminals or the like, confronting current carrying extensions projecting longitudinally from the inner end portions of said terminal forming blade portions, and a fuse-forming link formed in said portion of reduced thickness extending between the confronting portions of said current carrying extensions.

* * * * *